US006148539A

United States Patent [19]

Hatfield et al.

[11] Patent Number: 6,148,539

[45] Date of Patent: Nov. 21, 2000

[54] REGULATED BODY DRYER

[76] Inventors: Judith A. Hatfield; Mel E. Hatfield, III, both of P.O. Box 1931, Woodland, Wash. 98674

[21] Appl. No.: 09/306,213

[22] Filed: May 6, 1999

[51] Int. Cl.[7] ..... F26B 25/06

[52] U.S. Cl. ..... 34/223; 34/233

[58] Field of Search ..... 34/202, 229, 223, 34/225, 233; 392/380, 381, 384

[56] References Cited

U.S. PATENT DOCUMENTS

| | | | |
|---|---|---|---|
| 3,128,161 | 4/1964 | Hudon | 34/233 |
| 3,811,198 | 5/1974 | Baltes | 34/233 X |
| 4,471,537 | 9/1984 | Meda | 34/225 X |
| 4,871,900 | 10/1989 | Hickman | 34/202 X |
| 5,099,587 | 3/1992 | Jarosch | 34/202 |
| 5,873,179 | 2/1999 | Gregory et al. | 34/90 |
| 5,930,912 | 8/1999 | Carder | 34/90 |
| 5,996,249 | 12/1999 | Manning | 34/621 |

*Primary Examiner*—Stephen Gravini

[57] ABSTRACT

A body drier system is provided including an enclosure having a pair of opposed side walls and a top face coupled between top edges of the side walls. The side walls and the top face are each defined by an outer wall and an inner wall being spaced to define a hollow interior. Also included is a channel positioned within the side walls and the top face of the stall. Next provided is a plurality of vent assemblies mounted on an interior of the side walls and remaining in communication with the channel. Also included is a blower assembly including a fan for directing air through the channel and out of the vent assemblies upon the actuation thereof and a plurality of heating elements mounted within a flow of the air the fan for heating the air upon the actuation thereof. A control panel is provided for actuating the fan and the heating elements upon the depression thereof.

11 Claims, 2 Drawing Sheets

REGULATED BODY DRYER

BACKGROUND OF THE INVENTION

1. Field of the Invention

The present invention relates to blow dryers and more particularly pertains to a new regulated body dryer for drying a user after a shower.

2. Description of the Prior Art

The use of blow dryers is known in the prior art. More specifically, blow dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,099,587; U.S. Pat. No. 4,871,900; U.S. Pat. No. 3,128,161; U.S. Pat. No. 5,103,577; U.S. Pat. No. 3,282,193; and U.S. Pat. No. Des. 311,070.

In these respects, the regulated body dryer according to the present invention substantially departs from the conventional concepts and designs of the prior art, and in so doing provides an apparatus primarily developed for the purpose of drying a user after a shower.

SUMMARY OF THE INVENTION

In view of the foregoing disadvantages inherent in the known types of blow dryers now present in the prior art, the present invention provides a new regulated body dryer construction wherein the same can be utilized for drying a user after a shower.

The general purpose of the present invention, which will be described subsequently in greater detail, is to provide a new regulated body dryer apparatus and method which has many of the advantages of the blow dryers mentioned heretofore and many novel features that result in a new regulated body dryer which is not anticipated, rendered obvious, suggested, or even implied by any of the prior art blow dryers, either alone or in any combination thereof.

To attain this, the present invention generally comprises a stall having a base with a planar square configuration. As shown in FIG. 1, a drain is mounted on a central extent of the base for allowing the egress of water. A pair of opposed planar rectangular side walls are coupled to a second pair of opposed side edges of the base and extend upwardly therefrom. The side walls define an interior space and at least one side opening. A top face is coupled between top edges of the side walls. It should be noted that the side walls and the top face are each defined by an outer wall and an inner wall being spaced to define a hollow interior, as shown in FIGS. 1 & 2. Next provided is a channel defined by a pair of laterally spaced channel walls. As shown in FIG. 1, such channel walls are coupled between the outer wall and the inner wall of the side walls and the top face of the stall. The channel has a width of about ⅓ that of the stall and extends along central extents of the side walls and the top wall of the stall. For reasons that will soon become apparent, insulation is positioned within the hollow interior of the stall between the outer wall and the inner wall thereof. As shown in FIG. 1, the insulation essentially fills a space exterior of the channel. Also included is a plurality of vent assemblies including two pairs of vent assemblies each positioned on the inner wall of one of the side walls of the stall. Yet another vent assembly is positioned on the inner wall of the top face of the stall. As shown in FIG. 2, each vent assembly requires a rectangular cut out formed in the inner wall. A frame is positioned within the rectangular cut out. Pivotally coupled between opposite sides of the frame is a plurality of substantially planar rectangular vanes. A connector bar is pivotally coupled to an inner edge of each of the vanes for ensuring that the same move coincidentally between an open orientation and a closed orientation. A tab extends from a central extent of an outer edge of a middle vane. The tab serves for manually transferring the vanes between the open orientation and the closed orientation. FIG. 4 shows a blower assembly including a housing having a cylindrical side wall coupled to the outer wall of the top face of the stall about a circular opening formed therein. Such opening remains in communication with the channel. The housing of the blower assembly further includes a top face coupled to the side wall in spaced relationship with the top face of the stall. Mounted on the top face of the housing is a fan adapted to direct air through the channel and out of the vent assemblies upon the actuation thereof. Associated therewith is a plurality of heating elements mounted within the side wall between the opening and the fan for heating the air upon the actuation thereof. Finally, a control panel is provided including an actuator button for actuating the fan and the heating elements upon the depression thereof. The control panel further includes a dial for manually adjusting an extent to which the fan and the heating elements are actuated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new regulated body dryer apparatus and method which has many of the advantages of the blow dryers mentioned heretofore and many novel features that result in a new regulated body dryer which is not anticipated, rendered obvious, suggested, or even implied by any of the prior art blow dryers, either alone or in any combination thereof.

It is another object of the present invention to provide a new regulated body dryer which may be easily and efficiently manufactured and marketed.

It is a further object of the present invention to provide a new regulated body dryer which is of a durable and reliable construction.

An even further object of the present invention is to provide a new regulated body dryer which is susceptible of a low cost of manufacture with regard to both materials and labor, and which accordingly is then susceptible of low prices of sale to the consuming public, thereby making such regulated body dryer economically available to the buying public.

Still yet another object of the present invention is to provide a new regulated body dryer which provides in the apparatuses and methods of the prior art some of the advantages thereof, while simultaneously overcoming some of the disadvantages normally associated therewith.

Still another object of the present invention is to provide a new regulated body dryer for drying a user after a shower.

Even still another object of the present invention is to provide a new regulated body dryer that includes an enclosure having a pair of opposed side walls and a top face coupled between top edges of the side walls. The side walls and the top face are each defined by an outer wall and an inner wall being spaced to define a hollow interior. Also included is a channel positioned within the side walls and the top face of the stall. Next provided is a plurality of vent assemblies mounted on an interior of the side walls and remaining in communication with the channel. Also included is a blower assembly including a fan for directing air through the channel and out of the vent assemblies upon the actuation thereof and a plurality of heating elements mounted within a flow of the air the fan for heating the air upon the actuation thereof. A control panel is provided for actuating the fan and the heating elements upon the depression thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
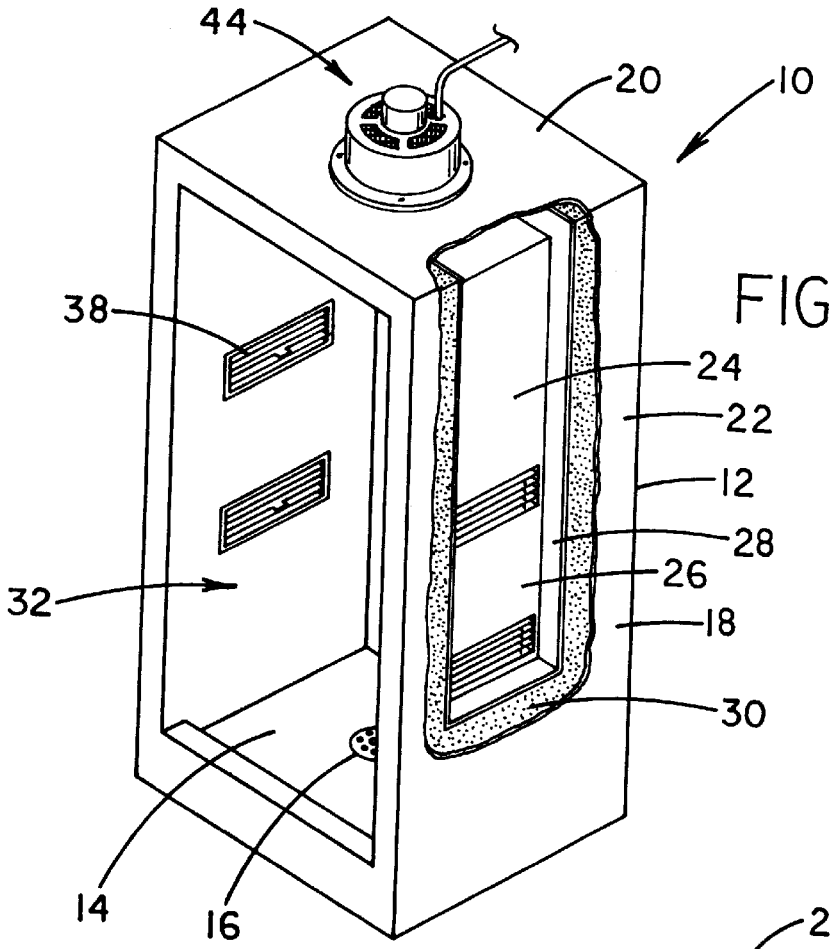
FIG. 1 is a perspective view of a new regulated body dryer according to the present invention.

With reference now to the drawings, and in particular to FIGS. 1 through 4 thereof, a new regulated body dryer embodying the principles and concepts of the present invention and generally designated by the reference numeral 10 will be described.

Figure 2:
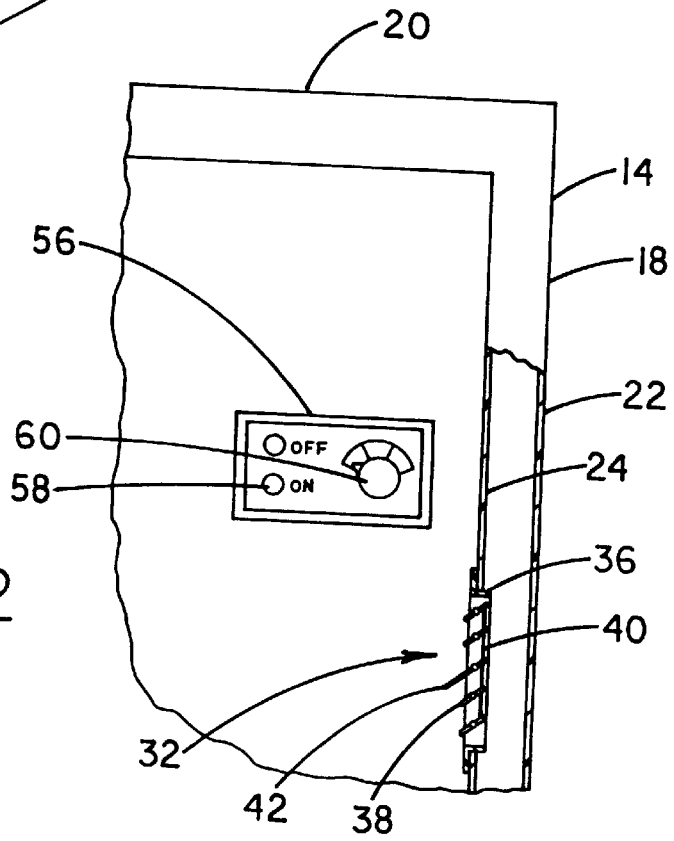
FIG. 2 is a side cross-sectional view of one of the vent assemblies of the present invention.

The present invention, designated as numeral 10, includes a stall 12 having a base 14 with a planar square configuration. As shown in FIG. 1, a drain 16 is mounted on a central extent of the base for allowing the egress of water. A pair of opposed planar rectangular side walls 18 are coupled to a second pair of opposed side edges of the base and extend upwardly therefrom. The side walls define an interior space and at least one side opening. Ideally, a third side wall encloses on one of the side openings. Further, a lip is preferably formed along an edge of the remaining side opening. A top face 20 is coupled between top edges of the side walls. It should be noted that the first pair of side walls and the top face are each defined by an outer wall 22 and an inner wall 24 being spaced to define a hollow interior, as shown in FIGS. 1 & 2.

Next provided is a channel 26 defined by a pair of laterally spaced channel walls 28. As shown in FIG. 1, such channel walls are coupled between the outer wall and the inner wall of the side walls and the top face of the stall. The channel has a width of about ⅓ that of the stall and extends along central extents of the side walls and the top wall of the stall. For reasons that will soon become apparent, insulation 30 is positioned within the hollow interior of the stall between the outer wall and the inner wall thereof. As shown in FIG. 1, the insulation essentially fills a space exterior of the channel.

Also included is a plurality of vent assemblies 32 including two pairs of vent assemblies each positioned on the inner wall of one of the side walls of the stall. Yet another vent assembly is positioned on the inner wall of the top face of the stall. As shown in FIG. 2, each vent assembly requires a rectangular cut out formed in the inner wall. A frame 36 is positioned within the rectangular cut out. Pivotally coupled between opposite sides of the frame is a plurality of substantially planar rectangular vanes 38. A connector bar 40 is pivotally coupled to an inner edge of each of the vanes for ensuring that the same move coincidentally between an open orientation and a closed orientation. A tab 42 extends from a central extent of an outer edge of a middle vane. The tab serves for manually transferring the vanes between the open orientation and the closed orientation.

Figure 4:
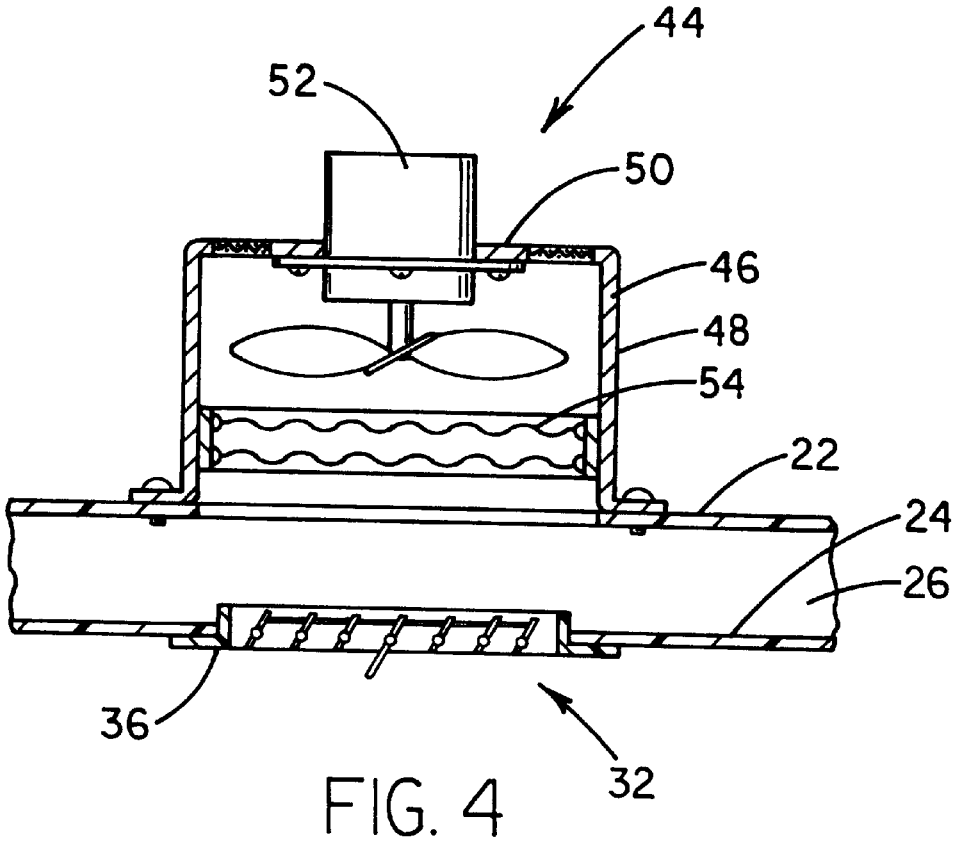
FIG. 4 is a side cross-sectional view of the blower assembly of the present invention.

FIG. 4 shows a blower assembly 44 including a housing 46 having a cylindrical side wall 48 coupled to a center of the outer wall of the top face of the stall about a circular opening formed therein. Such opening remains in communication with the channel. The housing of the blower assembly further includes a vented top face 50 coupled to the side wall in spaced relationship with the top face of the stall. Mounted on the top face of the housing is a fan 52 adapted to direct air through the channel and out of the vent assemblies upon the actuation thereof. Associated therewith is a plurality of heating elements 54 mounted within the side wall between the opening and the fan for heating the air upon the actuation thereof.

A waterproof control panel 56 is positioned on the third side wall and includes an actuator button 58 for actuating the fan and the heating elements upon the depression thereof. Associated therewith is another button for deactuation purposes. The control panel further includes a dial 60 for manually adjusting an extent to which the fan and the heating elements are actuated. The dial may be employed for either governing a duration of actuation or a level of heat and air flow generated by the blower assembly.

While not shown, a shower head assembly is preferably mounted on one of the pair of side walls above the vent assemblies. Further, a conventional pair of water control knobs are provided for controlling water flowing therefrom.

Figure 3:
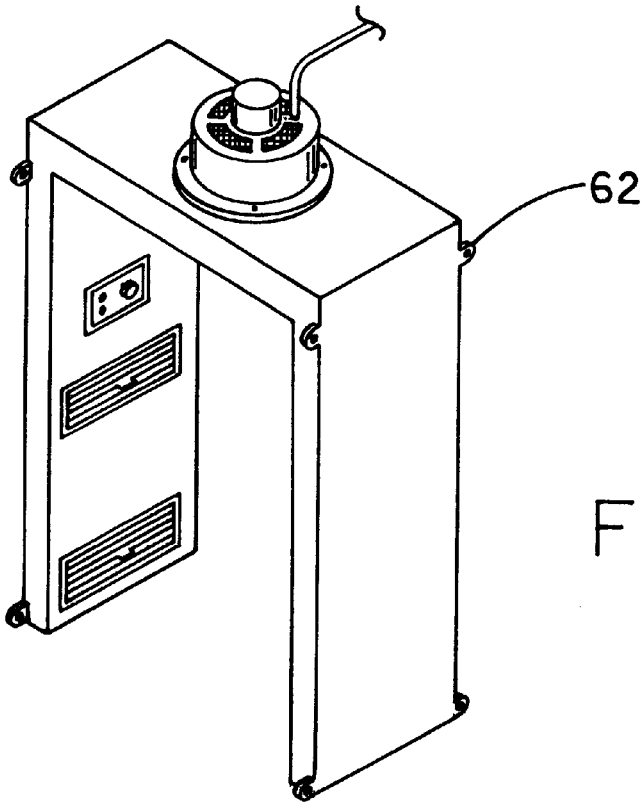
FIG. 3 is a perspective view of an alternate embodiment of the present invention.

As shown in FIG. 3, a plastic alternate embodiment is provided which is adapted for being mounted within a hollowed portion of a building or an existing shower stall. In such alternate embodiment, a pair of apertured tabs 62 are coupled to the side edges of the side walls at top and bottom ends thereof for being mounted to a recipient surface within the shower stall. Such apertured tabs preferably remain in coplanar relationship with an exterior surface of the outer wall of the enclosure. In the present embodiment, the control panel is preferably positioned on the inner wall of above the pair of vent assemblies.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A body drier system comprising, in combination:

a stall including a base with a planar square configuration having a drain mounted on a central extent thereof for allowing the egress of water, a pair of opposed planar rectangular side walls each coupled to a second pair of opposed side edges of the base and extending upwardly therefrom for defining an interior space and at least one side opening, and a top face coupled between top edges of the side walls, the side walls and the top face each defined by an outer wall and an inner wall being spaced to define a hollow interior;

a channel defined by a pair of laterally spaced channel walls coupled between the outer wall and the inner wall of the side walls and the top face of the stall, the channel having a width of about ⅓ that of the stall and extending along central extents of the side walls and the top wall of the stall;

insulation positioned within the hollow interior of the stall between the outer wall and the inner wall thereof and further exterior of the channel;

a plurality of vent assemblies including two pairs of vent assemblies each positioned on the inner wall of one of the side walls of the stall and a fifth vent assembly positioned on the inner wall of the top face of the stall, each vent assembly including a rectangular cut out formed in the inner wall, a frame positioned within the rectangular cut out, a plurality of substantially planar rectangular vanes pivotally coupled between opposite sides of the frame, a connector bar pivotally coupled to an inner edge of each of the vanes for ensuring that the same move coincidentally between an open orientation and a closed orientation, and a tab extending from a central extent of an outer edge of a middle vane for manually transferring the vanes between the open orientation and the closed orientation;

a blower assembly including a housing having a cylindrical side wall coupled to the outer wall of the top face of the stall about a circular opening formed therein and remaining in communication with the channel and a top face coupled to the side wall in spaced relationship with the top face of the stall, a fan mounted on the top face of the housing and adapted to direct air through the channel and out of the vent assemblies upon the actuation thereof, a plurality of heating elements mounted within the side wall between the opening and the fan for heating the air upon the actuation thereof; and a control panel including an actuator button for actuating the fan and the heating elements upon the depression thereof and a dial for manually adjusting an extent to which the fan and the heating elements are actuated.

2. A body drier system comprising:

an enclosure including a pair of opposed side walls and a top face coupled between top edges of the side walls, the side walls and the top face each defined by an outer wall and an inner wall being spaced to define a hollow interior;

a channel positioned within the side walls and the top face of the stall;

a plurality of vent assemblies mounted on an interior of the side walls and remaining in communication with the channel;

a blower assembly including a fan for directing air through the channel and out of the vent assemblies upon the actuation thereof and a plurality of heating elements mounted within a flow of the air of the fan for heating the air upon the actuation thereof;

a control panel for actuating the fan and the heating elements upon the depression thereof; and wherein the channel is insulated.

3. A body drier system as set forth in claim 2 wherein the control panel further includes a dial for manually adjusting an extent to which the fan and the heating elements are actuated.

4. A body drier system as set forth in claim 2 wherein the vent assemblies each include a frame, a plurality of substantially planar rectangular vanes pivotally coupled between opposite sides of the frame, a connector bar pivotally coupled to each of the vanes for ensuring that the same move coincidentally between an open orientation and a closed orientation, and a tab extending from one of the vanes for manually transferring the vanes between the open orientation and the closed orientation.

5. A body drier system as set forth in claim 2 wherein the enclosure includes a base having a drain mounted on a central extent thereof for allowing the egress of water.

6. A body drier system as set forth in claim 2 wherein the enclosure includes a pair of apertured tabs coupled to the side edges of the side walls at top and bottom ends thereof for being mounted to a recipient surface.

7. A body drier system comprising:

an enclosure including a pair of opposed side walls and a top wall extending between top edges of the side walls, the side walls and the top wall each being defined by an outer wall and an inner wall, the outer and inner walls being spaced to define a hollow interior;

a channel positioned in the side walls and the top wall of the stall;

a plurality of vent assemblies mounted on an interior of the side walls, the vent assemblies being in communication with the channel;

a blower assembly including a fan for directing air through the channel and out of the vent assemblies upon the actuation of the fan, and a plurality of heating elements mounted in a path of a flow of air from the fan for heating the air upon the actuation of the heating elements;

a control panel for actuating the fan and the heating elements upon the depression thereof; and wherein the channel is insulated.

8. A body drier system as set forth in claim 7 wherein the control panel further includes a dial for manually adjusting an extent to which the fan and the heating elements are actuated.

9. A body drier system as set forth in claim 7 wherein the vent assemblies each include a frame, a plurality of substantially planar rectangular vanes pivotally coupled between opposite sides of the frame, a connector bar pivotally coupled to each of the vanes for ensuring that the same move coincidentally between an open orientation and a closed orientation, and a tab extending from one of the vanes for manually transferring the vanes between the open orientation and the closed orientation.

10. A body drier system as set forth in claim 7 wherein the enclosure includes a base having a drain mounted on a central extent thereof for allowing the egress of water.

11. A body drier system as set forth in claim 7 wherein the enclosure includes a pair of apertured tabs coupled to the side edges of the side walls at top and bottom ends thereof for being mounted to a recipient surface.

* * * * *